United States Patent [19]

Welch

[11] 4,189,009

[45] Feb. 19, 1980

[54] WHEEL MOUNTED EARTH MOVING SCRAPER WITH PIVOT IN CENTER OF PIVOT AXLE

[76] Inventor: Rafael J. Welch, P.O. Box 175, St. John Welding and Mfg., Inc., St. John, Kans. 67576

[21] Appl. No.: 886,736

[22] Filed: Mar. 15, 1978

[51] Int. Cl.[2] ..... A01B 65/00

[52] U.S. Cl. ..... 172/384; 172/413; 172/459

[58] Field of Search ..... 172/225, 384, 413, 459, 172/460, 666, 779, 780, 797, 804; 37/129, DIG. 20

[56] References Cited

U.S. PATENT DOCUMENTS

| | | | |
|---|---|---|---|
| Re. 26,129 | 12/1966 | Pursche | 172/413 X |
| 2,051,283 | 8/1936 | Austin | 172/413 |
| 2,078,501 | 4/1937 | Maloon | 172/413 |
| 2,520,266 | 8/1950 | Adams | 172/4.5 |
| 2,656,776 | 10/1953 | Cox et al. | 172/459 |
| 3,561,538 | 2/1971 | Curlett et al. | 172/384 X |
| 4,055,222 | 10/1977 | Runte | 172/413 |
| 4,081,036 | 3/1978 | Yokoyama | 172/804 |

FOREIGN PATENT DOCUMENTS

| | | | |
|---|---|---|---|
| 1364115 | 5/1964 | France | 37/DIG. 20 |
| 1101473 | 1/1968 | United Kingdom | 37/DIG. 20 |

*Primary Examiner*—Richard T. Stouffer
*Attorney, Agent, or Firm*—Edwin H. Crabtree

[57] ABSTRACT

A wheel mounted earth moving scraper for towing behind a tractor or the like. The scraper mounted on a wheel axle. The scraper characterized by a scraper housing attached to a pivot axle which is pivotally attached to the wheel axle for pivoting the scraper housing transverse to the direction of travel of the scraper so that as the wheels mounted on the wheel axle travel on the ground surface, the scraper housing may be tilted independently of the wheels for levelling, grading, terracing, removing dirt build-up from buildings, tree rows and fences, and digging ditches.

5 Claims, 6 Drawing Figures

WHEEL MOUNTED EARTH MOVING SCRAPER WITH PIVOT IN CENTER OF PIVOT AXLE

BACKGROUND OF THE INVENTION

The subject invention relates generally to earth moving scrapers and more particularly, but not by way of limitation, to a wheel mounted earth moving scraper having a scraper housing which may be tilted in a plane transverse to the travel of the scraper and raised and lowered above the ground surface.

Heretofore, there have been many types of hydraulically operated wheel mounted and tractor mounted scrapers for earth moving. In particular, an adjustable blade is disclosed in U.S. Pat. No. 3,598,186 to Coontz and a hydraulically operated land contouring machine is described in U.S. Pat. No. 3,097,440 to Schmidt. There are adjustable blades on earth moving equipment disclosed in U.S. Pat. No. 1,928,778 to Austin and U.S. Pat. No. 3,776,318 to Layton. Also disclosed in U.S. Pat. No. 3,755,930 to Brandt et al is an adjustable blade on a snow grader. The above prior art patents are mentioned to disclose the state of art for earth moving and snow grading equipment having adjustable blades.

None of the above prior art patents disclose the specific structure of the subject invention or the advantages of the invention which are described herein.

SUMMARY OF THE INVENTION

The subject invention is a lightweight, heavy-duty earth moving scraper which is wheel mounted and is adapted for towing behind a tractor or the like. The subject invention provides the advantage of an earth moving scraper having a scraper housing which may be tilted for cutting into sloping ground adjacent a fence row, building structure, etc., or into mounds or humps of earth as the wheels of the scraper follow the ground surface.

The earth moving scraper provides the feature of tilting the scraper housing with a single hydraulic cylinder and ram. Also the scraper is raised and lowered on the wheel axle with a single hydraulic cylinder and ram.

The scraper is designed to have the scraper blade at an angle from the vertical which provides for an improved slicing motion into the ground surface as opposed to a lesser angle from the vertical which develops a dragging motion. The correct cutting angle of the scraper blade has been found to be in the range of 54° from the vertical.

The earth moving scraper for towing behind a tractor or the like includes a scraper housing having a vertically disposed moldboard with end plates mounted on the ends of the moldboard. A scraper blade is attached to the bottom of the moldboard. Attached to the top of the mold board and the end plates is an elongated tongue and tongue supports. The tongue is attached to the tractor by a swivel hitch. The scraper housing is pivotally attached to a scraper housing frame. The scraper housing frame is attached to a pivot axle. A wheel axle having a pair of wheels mounted at the ends thereof is pivotally attached and parallel to the pivot axle. A hydraulic cylinder and ram is attached to the pivot axle and wheel axle for pivoting the pivot axle and the scraper housing transverse to the direction of travel of the scraper. A second hydraulic cylinder and ram are mounted on the elongated tongue and attached to the scraper housing frame for raising and lowering the scraper housing on the wheel axle.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
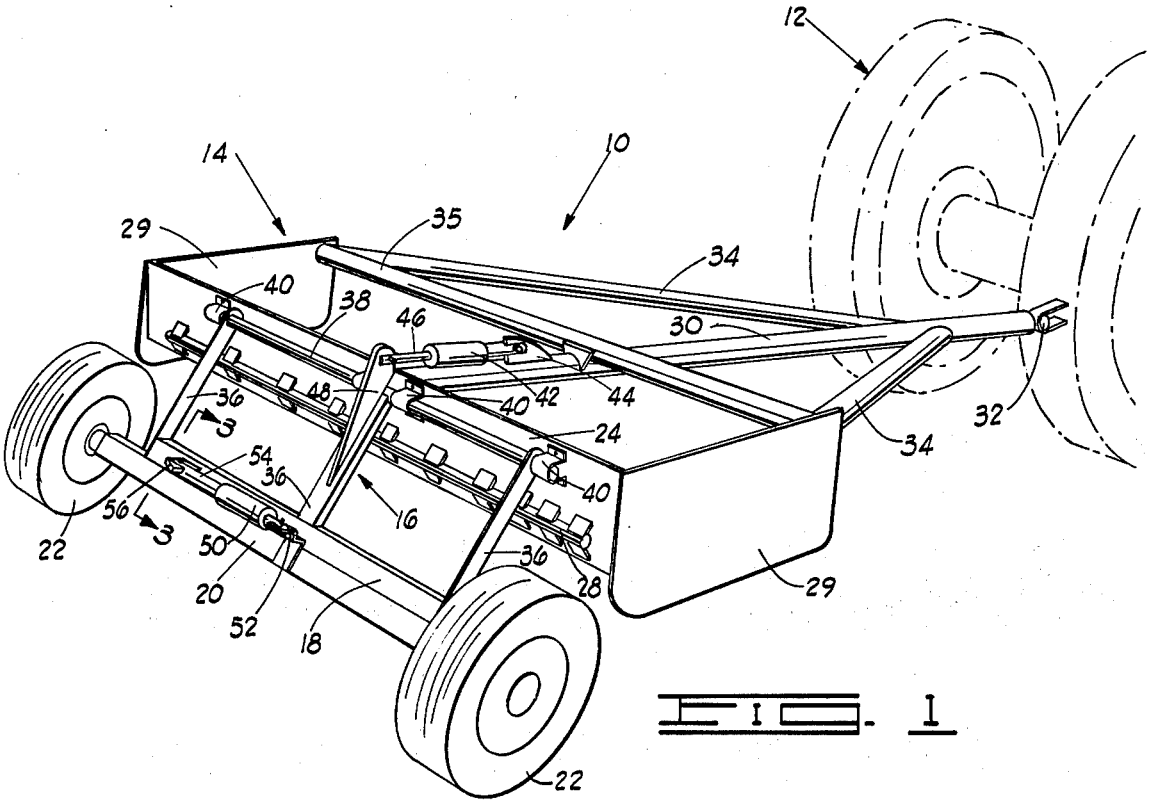
In FIG. 1, a perspective view of the wheel mounted earth moving scraper is shown attached to the rear of a tractor.

In FIG. 1, a perspective view of the wheel mounted earth moving scraper is shown. The scraper is designated by general reference numeral 10 and is pulled behind a tractor 12 which is shown in dotted lines. The scraper 10 includes a scraper housing 14, a scraper housing frame 16, a pivot axle 18, and a wheel axle 20 having a pair of wheels 22 attached to the ends of the wheel axle 20.

Figure 2:
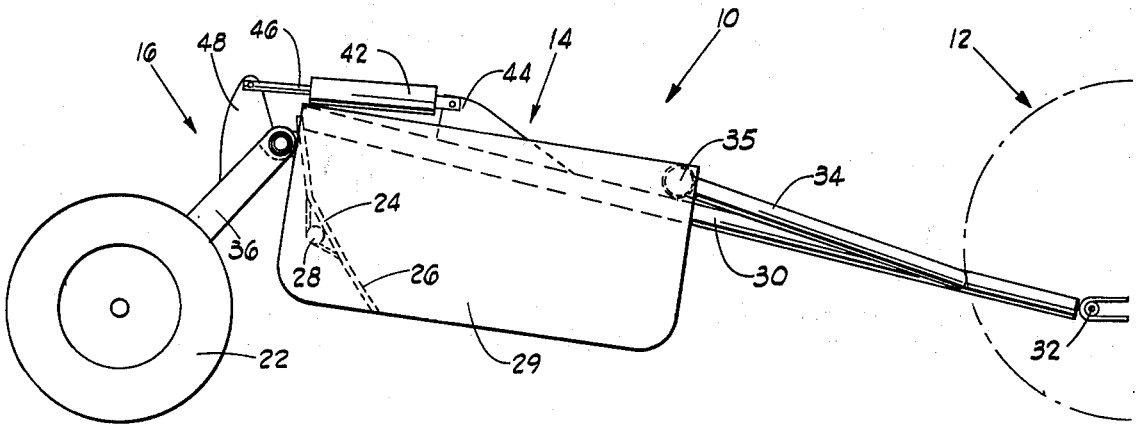
FIG. 2 is a side view of the earth moving scraper.

The scraper housing 14 incudes a vertically disposed moldboard 24 having a scraper blade 26 mounted on the bottom of the moldboard 24 and shown in dotted lines in FIG. 2. The moldboard 24 includes bracing 28 mounted on the back thereof and along the length of the moldboard 24 for supporting the moldboard 24 as the cutting blade 26 engages the ground surface. Mounted on the ends of the moldboard 24 are end plates 29. An elongated tongue 30 is attached at one end to the top of the moldboard 24 and centered thereon. The other end of the elongated tongue 30 includes a swivel hitch 32 for attaching the scraper 10 to the tractor 12. The scraper housing 14 further includes tongue supports 34 attached to a lateral support brace 35 and a portion of the elongated tongue 30. The lateral support brace 35 is attached to the top of the end plates 29 and 30. The brace 35 reinforces the structure of the scraper housing 14.

The scraper housing frame 16 includes three parallel frame arms 36 which have one end secured to an elongated pipe 38 which is pivotally mounted on pipe sleeves 40 which are strapped to the back of the moldboard 24. The other end of the frame arms 36 are attached to the pivot axle 18.

The pivot axle 18 is disposed adjacent and parallel to the wheel axle 20. The center of the length of the pivot axle 18 is pinned to the center of the length of the wheel axle 20. The pin connection is shown in detail in FIG. 3.

The scraper housing 14 is raised and lowered above the ground surface by a first hydraulic cylinder 42 attached to an anchor bracket 44 on top of the elongated tongue 30. A hydraulic ram 46 extending out of the cylinder 42 is attached to an anchor bracket 48 mounted on the center frame arm 36.

The scraper housing 14, scraper housing frame 16, and pivot axle 18 are pivoted in a direction transverse to the direction of travel of the scraper 10 by a second hydraulic cylinder 50 attached to an anchor bracket 52 secured to the wheel axle 20. Extending out of the hydraulic cylinder 50 is a hydraulic ram 54 attached to an anchor bracket 56 secured to the pivot axle 18. The hydraulic hoses for operating the hydraulic cylinders 42 and 50 are not shown in the drawings and would be connected to the hydraulic system of the tractor 12.

In FIG. 2, a side view of the wheel mounted earth moving scraper 10 is shown. In this view, the first hydraulic cylinder 42 is shown with the ram 46 in an extended position which pivots the scraper housing frame 16 and wheel axle 20 with wheels 22 toward the back of the scraper housing 14 thereby raising the scraper housing 14 above the ground surface. In this position, the scraper 10 releases the earth moved by the scraper blade 26 and moldboard 24 and is now in position for again being lowered into the ground surface. When the scraper housing 14 is lowered into position for the scraper blade 26 to cut into the ground surface, the blade 26 preferably is at an angle of approximately 54° from the vertical. This angle has been found desirable since it improves the slicing motion of the blade 26 into the ground surface as opposed to when the cutting blade 26 is at a lesser angle which tends to develop a dragging motion on the scraper 10. It can be appreciated that this angle will vary, but in the range of 54° from the vertical it is found that the scraper 10 works more efficiently in earth moving.

Figure 3:
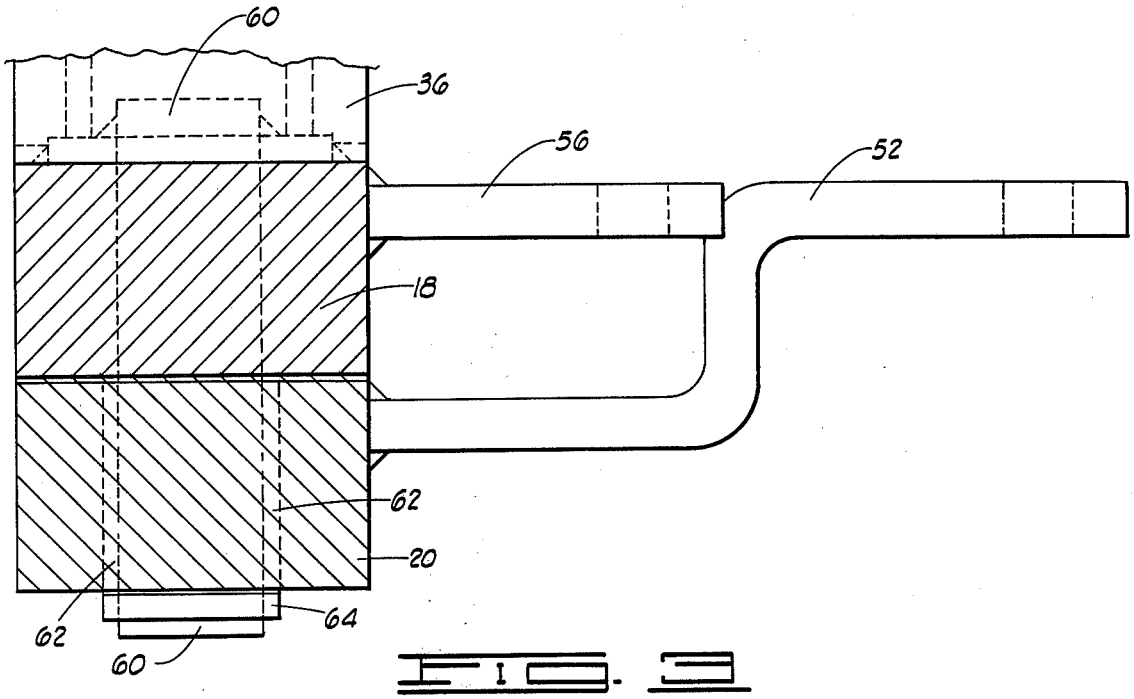
FIG. 3 is an enlarged sectional view of the pivot axle pinned to the wheel axle.

In FIG. 3, a cross section of the pivot axle 18, wheel axle 20, and a portion of the center frame arm 36 is shown taken along lines 3—3 in FIG. 1. In this view, a pivot pin 60 can be seen extending through the center of the pivot axle 18 and extending through the center of the wheel axle 20 where it is received in a pin sleeve 62. The sleeve 62 is shown in dotted lines. One end of the pin 60 is rigidly secured to the pivot axle 18. The other end of the pivot pin 60 is held onto the wheel axle 20 by a lock ring 64. As the hydraulic cylinder 50 and hydraulic ram 54 tilt the pivot axle 18, the pivot pin 60 rotates in the pin sleeve 62 in the wheel axle 20. Also shown in this view is a side view of the anchor brackets 52 and 56 which are used for mounting the hydraulic cylinder 50 and hydraulic ram 54 thereon.

Figure 4:
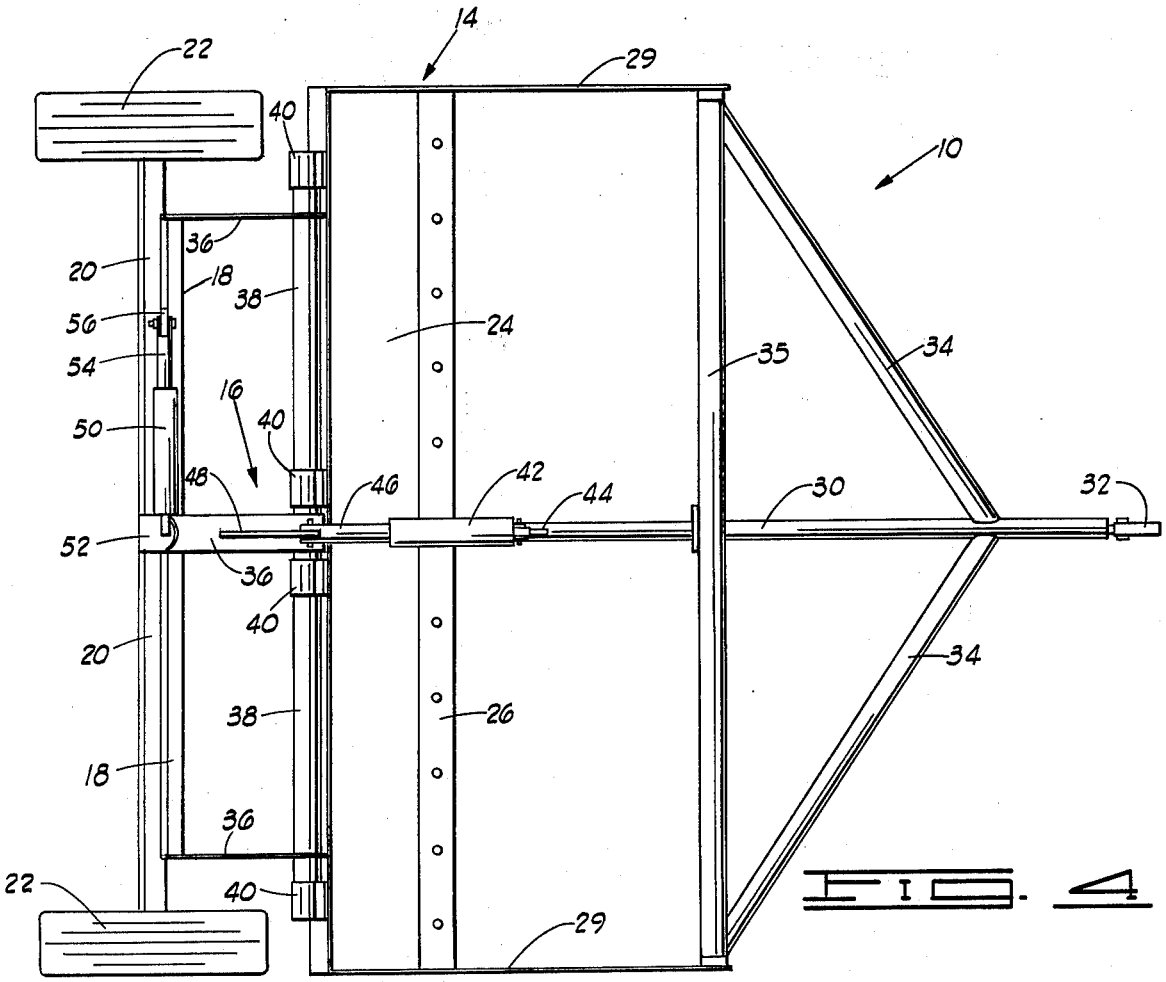
FIG. 4 is a top view of the earth moving scraper.

In FIG. 4, a top view of the scraper 10 is shown. In this view, the scraper blade 26 can be seen extending along the length of the moldboard 24 and attached to the bottom thereof. Also in this view, the pivot shaft 18 can be seen parallel to and extending along the length of the wheel axle 20.

Figure 5:
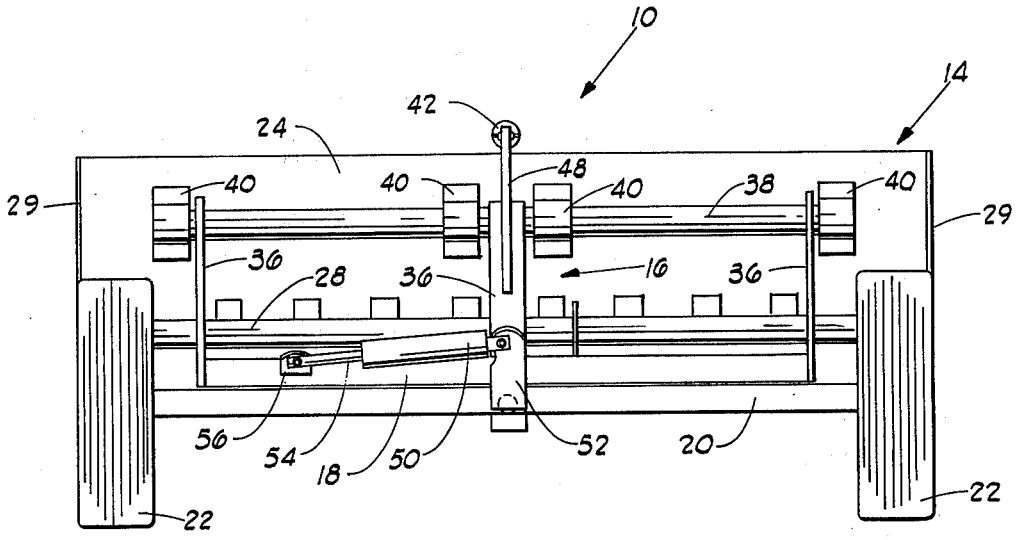
FIG. 5 is a rear view of the earth moving scraper with the scraper housing and scraper blade in a horizontal position.
Figure 6:
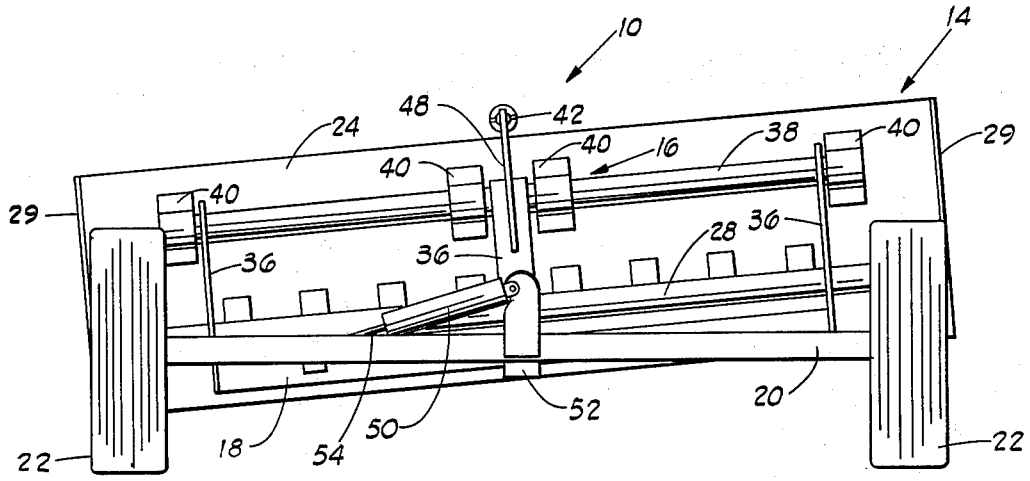
FIG. 6 is a rear view of the earth moving scraper with the left side of the scraper housing and scraper blade pivoted downwardly transverse to the direction of travel of the scraper.

In FIG. 5, a rear view of the scraper 10 is shown, In this view, the scraper housing 14, scraper housing frame 16, and pivot axle 18 are in a horizontal position. In FIG. 6, the hydraulic ram 54 has been extended outwardly from the hydraulic cylinder 50, thereby lowering the pivot shaft 18, scraper housing frame 16, and scraper housing 14 on the left hand side. The right hand side of the shaft 18, frame 16, and housing 14 has been raised. It should be appreciated by either extending or retracting the ram 54, the scraper housing 14, scraper frame 16, and pivot axle 18 may be lowered and raised on both sides of the scraper 10 an equal distance. This feature provides the advantage of independently tilting the scraper housing 14 from the wheel axle 20 and wheels 22 for cutting into sloping ground, mounds, and humps while the wheels 22 ride over the contour of the earth's surface.

Changes may be made in the construction and arrangement of the parts or elements of the embodiment as disclosed herein without departing from the spirit or scope of the invention as defined in the following claims.

I claim:

1. An earth moving scraper for towing behind a tractor or the like, the scraper comprising:

a scraper housing, the housing including a vertically disposed moldboard, a scraper blade mounted on the bottom of the moldboard, a pair of end plates attached to the ends of the moldboard, and an elongated tongue with one end attached to the top of and centered on the moldboard, the other end of the tongue attached to a swivel hitch, the hitch adapted for attachment to the rear of the tractor;

a scraper housing frame pivotally attached to the back of the moldboard and adjacent the top edge thereof, the scraper housing frame supporting the scraper housing;

a first pivot means attached to the scraper housing and the scraper housing frame and adjacent the pivotal attachment to the moldboard for raising and lowering the scraper housing above the ground surface;

a pivot axle attached to the scraper housing frame;

a wheel axle having a pair of wheels mounted at the ends thereof, the wheel axle parallel to and pivotally attached to the pivot axle, the pivot axle being pivotally attached to the wheel axle by a pivot pin secured to and extending through the center of the pivot axle and extending through a pin sleeve disposed in the center of the wheel axle, when the pivot axle is pivoted on the wheel axle, the pin rotating in the pin sleeve; and a second pivot means attached to the wheel axle and the pivot axle for pivoting the pivot axle, the scraper housing frame, and the scraper housing transverse to the direction of travel of the scraper.

2. The scraper as described in claim 1, wherein the first pivot means is a hydraulic cylinder and hydraulic ram attached to the tongue and the scraper housing frame.

3. The scraper as described in claim 1, wherein the second pivot means is a hydraulic cylinder and hydraulic ram attached to the wheel axle and pivot axle.

4. The scraper as described in claim 1 further including support bracing extending along the length of the back of the moldboard for supporting the moldboard and the scraper blade.

5. An earth moving scraper for towing behind a tractor or the like, the scraper comprising:

a scraper housing, the housing including a vertically disposed moldboard, a scraper blade mounted on the bottom of the moldboard, a pair of end plates attached to the ends of the moldboard, and an elongated tongue attached to the top of and centered on the moldboard, the end of the tongue attached to a swivel hitch, the hitch adapted for attachment to the rear of the tractor;

a scraper housing frame pivotally attached to the back of the moldboard and adjacent the top edge thereof, the scraper housing frame supporting the scraper housing;

a first hydraulic cylinder and ram attached to the tongue and the scraper housing frame adjacent the pivotal attachment to the moldboard for raising and lowering the scraper housing above the ground surface;

a pivot axle attached to the scraper housing frame;

a wheel axle having a pair of wheels mounted at the ends thereof, the wheel axle parallel to and pivotally attached to the pivot axle, the pivot axle being pivotally attached to the wheel axle by a pivot pin secured to and extending through the center of the pivot axle and extending through a pin sleeve disposed in the center of the wheel axle, when the pivot axle is pivoted on the wheel axle, the pin rotating in the pin sleeve; and a second hydraulic cylinder and ram attached to the wheel axle and the pivot axle for pivoting the pivot axle, the scraper housing frame, and the scraper housing transverse to the direction of travel of the scraper.

* * * * *